US006497242B1

(12) United States Patent
Lin et al.

(10) Patent No.: US 6,497,242 B1
(45) Date of Patent: Dec. 24, 2002

(54) MULTIPLE-FOLD UMBRELLA RIB ASSEMBLY HAVING INNER RIBS OF ALUMINUM ALLOY AND OUTER RIBS OF CARBON-FIBER-REINFORCED PLASTICS

(75) Inventors: Chung-Kuang Lin, Taipei Hsien (TW); Jung-Jen Chang, Taipei Hsien (TW)

(73) Assignee: Fu Tai Umbrella Works, Ltd., Taipei Hsien (TW)

( * ) Notice: Subject to any disclaimer, the term of this patent is extended or adjusted under 35 U.S.C. 154(b) by 72 days.

(21) Appl. No.: 09/709,448

(22) Filed: Nov. 13, 2000

(51) Int. Cl.[7] ..... A45B 19/10
(52) U.S. Cl. ..... 135/31; 135/25.3
(58) Field of Search ..... 135/25.1, 25.3, 135/29, 31, 32

(56) References Cited

U.S. PATENT DOCUMENTS 5,392,799 A * 2/1995 Lai ..... 135/25.3
5,435,331 A * 7/1995 Okuda ..... 135/29
5,551,463 A * 9/1996 Wang ..... 135/25.3
5,597,004 A * 1/1997 Okuda ..... 135/29
5,931,175 A 8/1999 Lin et al.
5,975,099 A * 11/1999 Johnson ..... 135/29
6,095,169 A * 8/2000 Lin ..... 135/31
6,164,302 A * 12/2000 Ko ..... 135/25.3
6,164,303 A * 12/2000 Lin ..... 135/29
6,202,661 B1 * 3/2001 Okuda ..... 135/29
6,206,017 B1 * 3/2001 Johnson ..... 135/29
6,230,725 B1 * 5/2001 Ko ..... 135/31
6,296,001 B1 * 10/2001 Lin ..... 135/31

* cited by examiner

*Primary Examiner*—Jose V. Chen
*Assistant Examiner*—Winnie Yip
(74) *Attorney, Agent, or Firm*—Troxell Law Office PLLC

(57) ABSTRACT

An umbrella rib assembly includes a top rib pivotally connected with a stretcher rib both being made of aluminum alloy for light weight and easy processing; a middle rib pivotally secured to the stretcher rib and a tail rib pivotally connected with the middle rib, with the middle rib and the tail rib being made of light weight carbon-fiber-reinforced plastics.

1 Claim, 4 Drawing Sheets

MULTIPLE-FOLD UMBRELLA RIB ASSEMBLY HAVING INNER RIBS OF ALUMINUM ALLOY AND OUTER RIBS OF CARBON-FIBER-REINFORCED PLASTICS

BACKGROUND OF THE INVENTION

This application is an improvement of U.S. Pat. No. 5,931,175 (hereinafter called "the prior patent") issued to the same inventors of this application.

The prior patent disclosed an umbrella rib assembly including a top rib made of light material including aluminum alloy and an outer rib made of composite or plastic materials having good resilience and mechanical strength to be connected with the top rib. However, such a rib assembly is not suitable for forming a multiple-fold umbrella having three or two folds.

The present inventor has found the limitation of the prior patent and invented the present rib assembly provided for multiple-fold umbrella.

SUMMARY OF THE INVENTION

The object of the present invention is to provide an umbrella rib assembly including a top rib pivotally connected with a stretcher rib both being made of aluminum alloy for light weight and easy processing; a middle rib pivotally secured to the stretcher rib and a tail rib pivotally connected with the middle rib, with the middle rib and the tail rib being made of light weight carbon-fiber-reinforced plastics.

DETAILED DESCRIPTION

As shown in FIG. 1 through FIG. 5, the present invention comprises a rib assembly 2 pivotally secured to a central shaft 1. The rib assembly 2 may be provided for an umbrella having triple or three folds.

Figure 1:
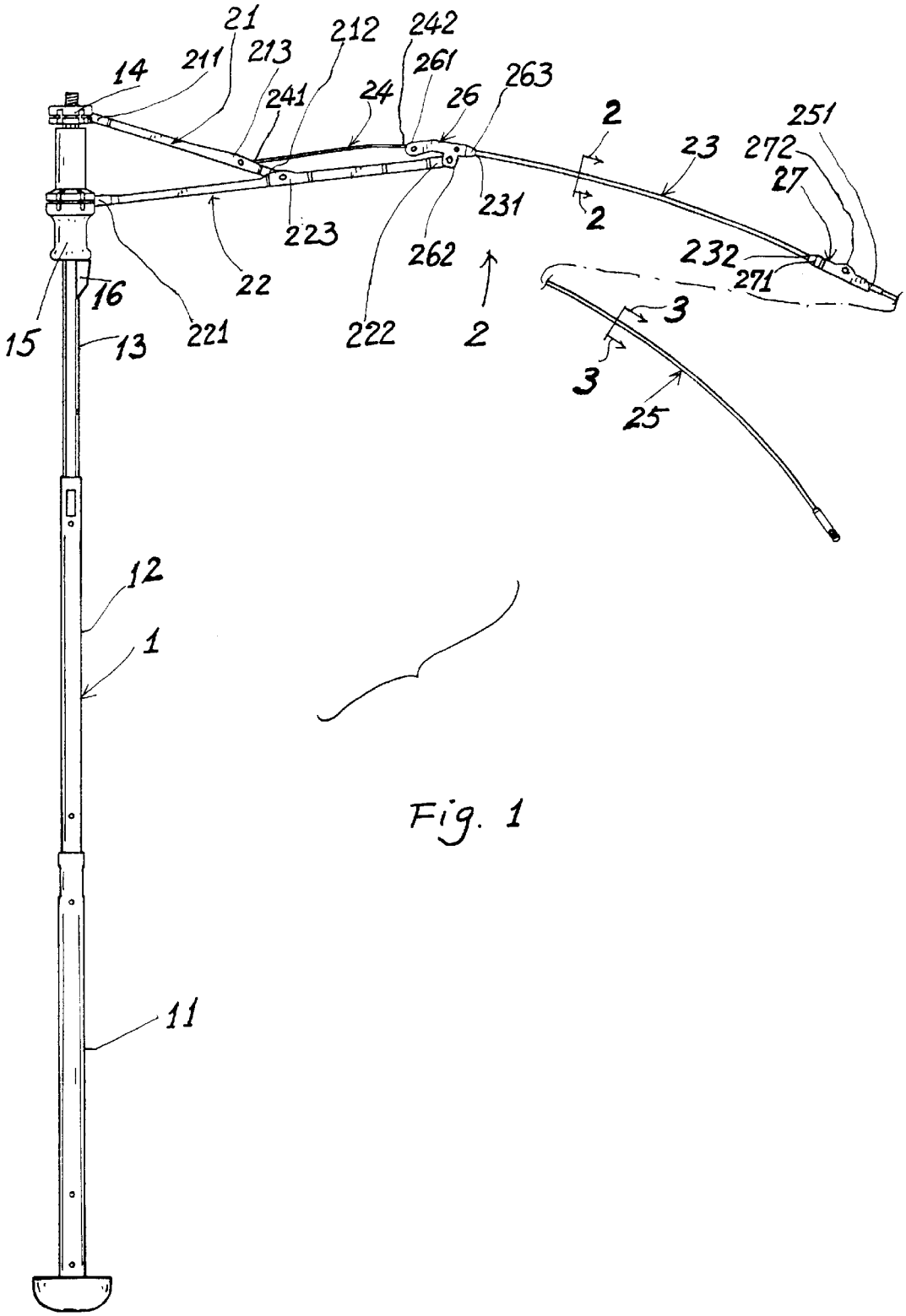
FIG. 1 is an illustration showing an open umbrella of the present invention.

The central shaft 1 includes: a lower tube 11, a middle tube 12, and an upper tube 13, with tubes 11, 12, 13 telescopically coupled with one another; an upper notch 14 formed on an upper portion of the upper tube 13; a runner 15 slidably held on the shaft 1 and a catch 16 resiliently held in the shaft 1 for locking the runner 15 on the shaft 1 when the umbrella in an opened position as shown in FIG. 1.

The rib assembly 2 includes: a top rib 21 having a cross section of U shape and having its inner end 211 pivotally secured with the upper notch 14 on the shaft 1; a stretcher rib 22 having a cross section of U shape, and having its inner end 221 pivotally secured with the runner 15 and a middle (pivotal) portion 223 of the stretcher rib 22 pivotally connected to an outermost end 212 of the top rib 21; a middle rib 23 having its inner end 231 secured to a rear end portion 263 of an inner joint 26; an auxiliary rib 24 made of steel or other materials having high strength and having an inner end 241 pivotally secured to an outer portion 213 of the top rib 21 and having an outer end 242 of the auxiliary rib 24 pivotally connected with an inner end portion 261 of the inner joint 26 of which a pair of lugs 262 are pivotally secured with an outer end 222 of the stretcher rib 22; and a tail rib 25 having its inner end 251 pivotally secured to a pair of lugs 272 formed on an outer joint 27 of which a front end portion 271 of the outer joint 27 is secured to an outer end 232 of the middle rib 23.

Figure 2:
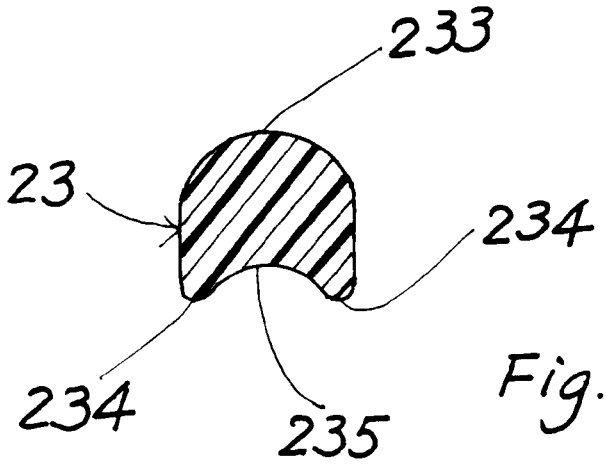
FIG. 2 is a cross sectional drawing of the middle rib as viewed from line 2—2 of FIG. 1.

The middle rib 23 includes an upper convex portion 233 longitudinally formed on an upper portion of the rib 23, two reinforcing ribs 234 longitudinally formed on opposite bottom edge portions of a bottom portion of the middle rib 23 (when opening the umbrella), and a bottom concave portion 235 longitudinally recessed in the bottom portion of the middle rib 23 between the two reinforcing ribs 234 especially as shown in FIG. 2.

The middle rib 23 and the tail (or outermost) rib 25 are made of carbon-fiber-reinforced plastics for a lighter weight and high strength.

Figure 3:
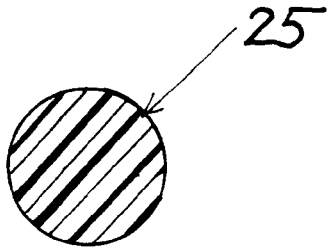
FIG. 3 is a cross sectional drawing as viewed from line 3—3 of FIG. 1.
Figure 5:
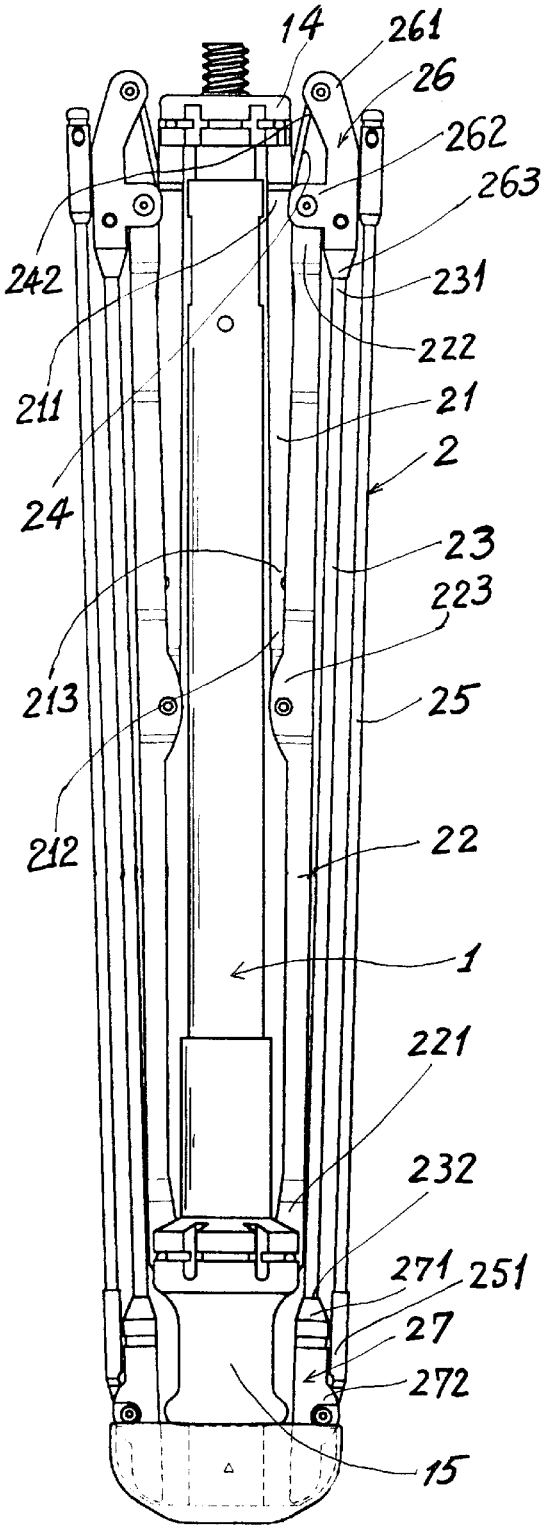
FIG. 5 shows a folded umbrella of the present invention.

The tail rib 25 as shown in FIG. 3 has a cross section of circular shape.

The two reinforcing ribs 234 formed on the middle rib 23 may help prevent twisting of the rib 23 in order to stabilize the rib 23 when opening the umbrella.

Figure 4:
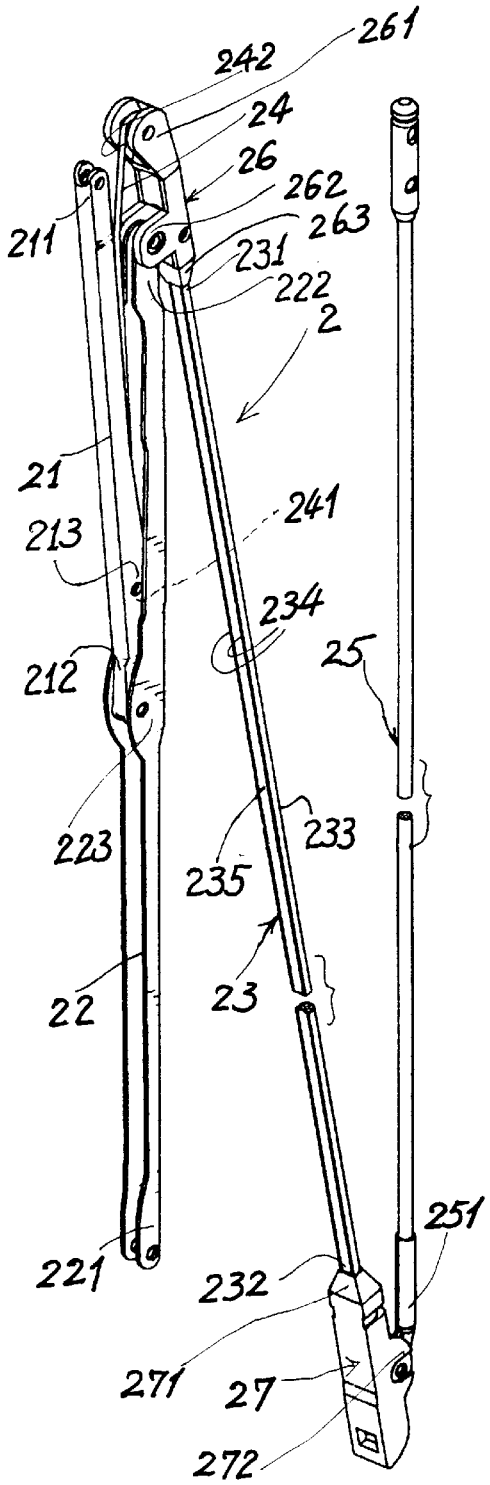
FIG. 4 is a perspective view of the rib assembly of the present invention.

The top rib 21 and the stretcher rib 22 are made of aluminum alloy for light weight and easy processing since the pivot holes may be directly processed and drilled in the ribs 21, 22; such as in the inner ends 211, 221 of the top rib 21 and stretcher rib 22; and in the outermost ends 212, 222 of the top rib 21 and stretcher rib 22; and in the middle pivotal portions 213, 223 of the top rib 21 and stretcher rib 22 (FIG. 4). So, no additional joints are required to be formed on the top rib 21 and the stretcher rib 22.

Figure 6:
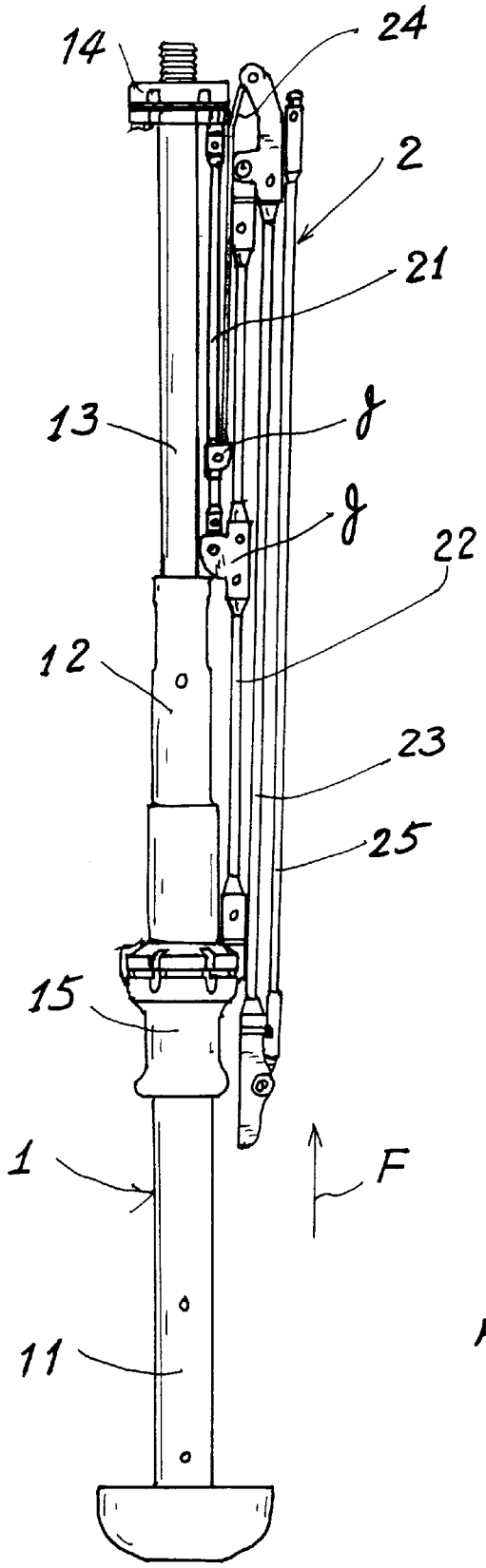
FIG. 6 is an inferential drawing if the top rib and the stretcher rib were made of carbon-fiber-reinforced plastics.

If the top rib 21 and the stretcher rib 22 were made of carbon-fiber-reinforced plastic materials as shown in FIG. 6, several joints J are additionally required to be connected with the top and stretcher ribs 21, 22 of carbon-fiber-reinforced plastics for pivotally connecting the relevant ribs of the rib assembly since the carbon-fiber plastic ribs are too hard to be easily processed for drilling or forming the pivot holes for pivotally connecting the relevant ribs of the rib assembly, thereby increasing the production complexity and cost and thereby obstructing the tubes 12, 11 of the central shaft 1 by the several joints J formed on the top rib 21 and stretcher rib 22 when folding (F) and closing the umbrella.

Thanks to the present invention, the "inner ribs" including the top rib 21 and the stretcher rib 22 are made of aluminum alloy without additional joints formed on the ribs 21, 22, thereby preventing obstruction of the tubes of the central shaft 1 when retracted by closing the umbrella; while the "outer ribs" including the tail rib 25 and the middle rib 23 are made of carbon-fiber-reinforced plastics, thereby providing light-weight and high-strength properties. So, the present invention is superior to and improved over the prior patent, e.g., U.S. Pat. No. 5,931,175.

The present invention may be modified without departing from the spirit and scope of the present invention.

We claim:

1. A multiple-fold umbrella rib assembly comprising:

a top rib having a cross section of U shape and pivotally secured to an upper notch formed on an upper portion of a central shaft;

a stretcher rib having a cross section of U shape and pivotally secured to a runner slidably held on the central shaft, and said stretcher rib pivotally secured to said top rib;

a middle rib pivotally secured to said stretcher rib, and pivotally secured to said top rib by an auxiliary rib; and a tail rib pivotally secured to said middle rib;

the improvement which comprises:

a. said top rib and said stretcher rib being made of aluminum alloy;

b. said middle rib made of carbon-fiber-reinforced plastics and having an upper convex portion longitudinally formed on an upper portion of said middle rib, two reinforcing ribs longitudinally formed on opposite bottom edge portions of a bottom portion of said middle rib, and a bottom concave portion longitudinally recessed in said bottom portion of said middle rib between said two reinforcing ribs when opening the umbrella; and c. said tail rib made of carbon-fiber-reinforced plastics and having a cross section of circular shape.

* * * * *